US006798277B2

(12) United States Patent
Nakashimo et al.

(10) Patent No.: US 6,798,277 B2
(45) Date of Patent: Sep. 28, 2004

(54) REFERENCE VOLTAGE CIRCUIT AND ELECTRONIC DEVICE

(75) Inventors: Takao Nakashimo, Chiba (JP); Atsuo Fukui, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/349,887

(22) Filed: Jan. 23, 2003

(65) Prior Publication Data

US 2003/0174014 A1 Sep. 18, 2003

(30) Foreign Application Priority Data

Jan. 29, 2002 (JP) ..... 2002-020624
Dec. 4, 2002 (JP) ..... 2002-352220

(51) Int. Cl.[7] ..... G05F 1/10
(52) U.S. Cl. ..... 327/541
(58) Field of Search ..... 327/530, 534, 327/535, 537, 538, 539, 540, 541, 543

(56) References Cited

U.S. PATENT DOCUMENTS 4,267,501 A * 5/1981 Smith ..... 3223/313
4,812,735 A * 3/1989 Sawada et al. ..... 323/313
5,296,801 A * 3/1994 Ohtsuka et al. ..... 323/313
6,072,723 A * 6/2000 Guliani et al. ..... 365/185.18

* cited by examiner

*Primary Examiner*—Jeffrey Zweizig
(74) *Attorney, Agent, or Firm*—Adams & Wilks

(57) ABSTRACT

A reference voltage circuit is provided in which a difference of voltages applied to reference voltage circuits is reduced so that a difference of respective output voltages is made small. Depletion type MOS transistors (3, 6) are respectively connected in series with the drains of depletion type MOS transistors (1, 4) in two ED type reference voltage circuits. The gate of one of the series-connected depletion type MOS transistors (3, 6) is connected with the source of the other MOS transistor and the gate of the other MOS transistor is connected with the source of the one MOS transistor. Thus, a difference of voltages applied to the respective ED type reference voltage circuits is reduced so that a difference of respective output voltages is made small.

15 Claims, 5 Drawing Sheets

REFERENCE VOLTAGE CIRCUIT AND ELECTRONIC DEVICE

BACKGROUND OF THE INVENTION

1. Field of the Invention

The present invention relates to a semiconductor device for outputting a constant reference voltage.

2. Description of the Related Art

Up to now, a circuit shown in FIG. 2 is used as a reference voltage circuit in which a stable output voltage is obtained regardless of variations in power source voltage and temperature (for example, see JP 04-065546 B (pp.6 and 7, FIG. 2)).

With respect to a configuration of the circuit, the source of a depletion mode (or type) MOS transistor 1 and the drain of an enhancement mode (or type) MOS transistor 2 having the same conductivity type are connected in series with each other. The gate and the source of the depletion type MOS transistor 1 are connected with each other. The gate and the drain of the enhancement type MOS transistor 2 are connected with each other. A high voltage supply terminal 100 is provided at the drain of the depletion type MOS transistor 1. A low voltage supply terminal 101 is provided at the source of the enhancement type 1405 transistor. An output terminal 110 is provided at a connection point of both the above-mentioned MOS transistors. Hereinafter, such a circuit is called an ED type (enhancement depletion type) reference voltage circuit. The terminal 100 is assumed to be a high voltage supply terminal of an ED type reference voltage.

The reference voltage circuit should ideally output a constant voltage even in the case of any voltage. However, actually, an output voltage is varied according to an applied voltage. Thus, there is the case where a cascode circuit for keeping a voltage applied to the ED type reference voltage circuit constant is added.

FIG. 3 shows an example of an ED type reference voltage circuit added with a cascode circuit for keeping a voltage applied to the ED type reference voltage circuit constant between the high voltage supply terminal 112 of the ED type reference voltage circuit and a high voltage supply terminal 100.

The high voltage supply terminal 112 of the ED type reference voltage circuit (the drain of the depletion type MOS transistor 1) and the source of a MOS transistor 7 having the same conductivity type are connected in series with each other. The drain of the MOS transistor 7 having the same conductivity type is connected with the high voltage supply terminal 100. Thus, it is constructed that a constant voltage is supplied from a constant voltage source 10 to the gate. According to such a configuration, when a voltage at the high voltage supply terminal 100 is a certain voltage or higher, the voltage applied to the high voltage supply terminal 112 of the ED type reference voltage circuit becomes a constant voltage. Thus, even when the voltage at the high voltage supply terminal 100 is varied, there is no case where a voltage at the output terminal 110 of the ED type reference voltage circuit is influenced by the variation.

FIG. 4 shows a circuit in the case where two ED type reference voltage circuits each having the above configuration are used. In the case of the circuit shown in FIG. 4, the same voltage is supplied to transistors 7 and 8 having the same conductivity type for which cascode connection is made. However, a voltage between the gate and the source is changed for the respective transistors 7 and 8 having the same conductivity type due to a cause such as mask shift. Thus, a voltage difference is produced between high voltage supply terminals 112 and 113 of the respective ED type reference voltage circuits so that there is the case where a difference of output voltages is caused due to a difference of voltages applied to the high voltage supply terminals of the ED type reference voltage circuits. Accordingly, this becomes a problem in the case where it is required that voltages at output terminals 110 and 111 of two reference voltage circuits are matched with high precision.

SUMMARY OF THE INVENTION

According to the present invention, in order to solve the above-mentioned problem, the source of a depletion type MOS transistor is connected in series with the drain of a depletion type MOS transistor in each of two ED type reference voltage circuits, the gate of one of the series-connected depletion type MOS transistors is connected with the source of the other MOS transistor and the gate of the other MOS transistor is connected with the source of the one MOS transistor. Thus, a difference of voltages applied to the respective ED type reference voltage circuits is reduced.

A reference voltage circuit according to the present invention includes: a first voltage terminal; a second voltage terminal; a first ED type reference voltage circuit connected between the first voltage terminal and the second voltage terminal; and a first depletion MOS transistor connected between the first voltage terminal and the first ED type reference voltage circuit. The reference voltage circuit further includes: a second ED type reference voltage circuit connected between the first voltage terminal and the second voltage terminal; and a second depletion MOS transistor connected between the first voltage terminal and the second ED type reference voltage circuit. Further, in the reference voltage circuit, a gate terminal of the first depletion MOS transistor is connected with a potential between the second ED type reference voltage circuit and the second depletion MOS transistor, and a gate terminal of the second depletion MOS transistor is connected with a potential between the first ED type reference voltage circuit and the first depletion MOS transistor.

Further, the reference voltage circuit according to the present invention is characterized in that: the first and second ED type reference voltage circuits each includes a depletion MOS transistor and an enhancement MOS transistor which are connected in series with each other; and a gate electrode of the depletion MOS transistor and a gate electrode of the enhancement MOS transistor are common and a voltage on a connection point of the depletion MOS transistor and the enhancement MOS-transistor is used as an output.

An electronic device according to the present invention is characterized by including the above-mentioned reference voltage circuit.

DETAILED DESCRIPTION OF THE PREFERRED EMBODIMENTS

Figure 1:
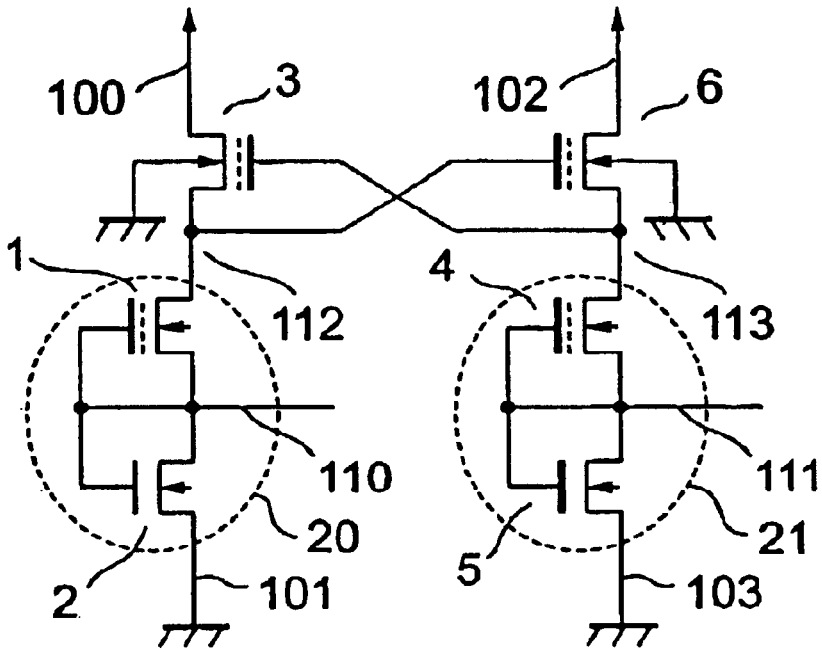
FIG. 1 shows an example of a reference voltage circuit of the present invention.
Figure 2:
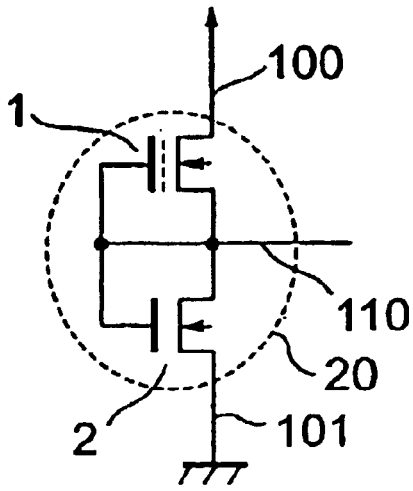
FIG.2 PRIOR ART
FIG. 2 shows an example of a conventional reference voltage circuit.
Figure 3:
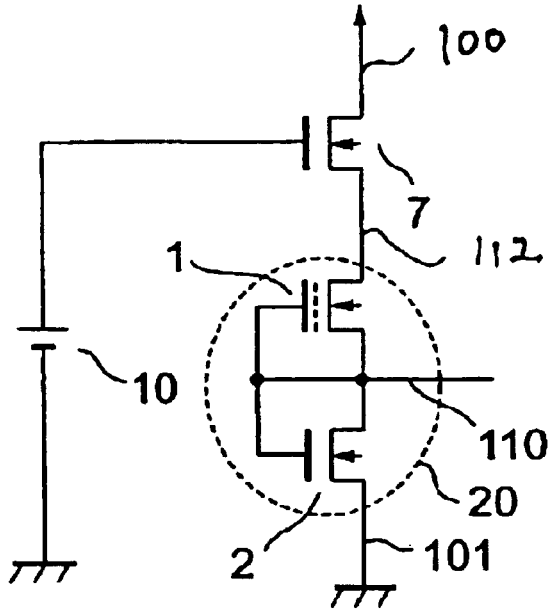
FIG.3 PRIOR ART
FIG. 3 shows an example of a conventional reference voltage circuit.
Figure 4:
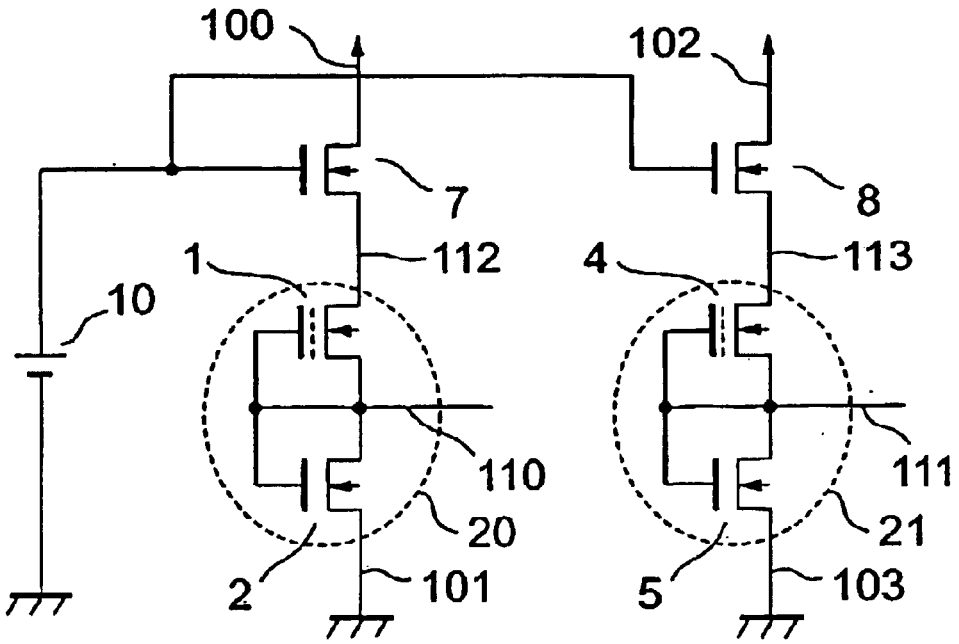
FIG.4 PRIOR ART
FIG. 4 shows an example of a conventional reference voltage circuit.

FIG. 1 is a circuit diagram of a reference voltage circuit of the present invention. Hereinafter, embodiments of the present invention will be described with reference to FIG. 1.

The source of a depletion type MOS transistor 1 and the drain of an enhancement type MOS transistor 2 having the same conductivity type are connected in series with each other. The gate and the source of the depletion type MOS transistor 1 are connected with each other. The gate and the drain of the enhancement type MOS transistor 2 are connected with each other. The drain of the depletion type MOS transistor 1 is connected in series with the source of a depletion type MOS transistor 3.

In order to output the same voltage, the same configuration is used. In other words, the source of a depletion type MOS transistor 4 having the same conductivity type and the drain of an enhancement type MOS transistor 5 are connected in series with each other. The gate and the source of the depletion type MOS transistor 4 are connected with each other. The gate and the drain of the enhancement type MOS transistor 5 are connected with each other. The drain of the depletion type MOS transistor 4 is connected in series with the source of a depletion type MOS transistor 6.

Also, the gate of the above depletion type MOS transistor 3 is connected with a high voltage supply terminal 113 of an ED type reference voltage circuit 21. The gate of the above depletion type MOS transistor 6 is connected with a high voltage supply terminal 112 of an ED type reference voltage circuit 20. The drain of the above depletion type MOS transistor 3 is connected with a high voltage supply terminal 100. The drain of the above depletion type MOS transistor 6 is connected with a high voltage supply terminal 102 of the ED type reference voltage circuit.

Further, the source of the above enhancement transistor 2 is connected with a low voltage supply terminal 101. The source of the above enhancement transistor 5 is connected with a low voltage supply terminal 103. A base (or substrate) potential of the above depletion transistor 3 having the same conductivity type is connected with the low voltage supply terminal 101. A base (or substrate) potential of the depletion transistor 6 having the same conductivity type is connected with the low voltage supply terminal 103.

Figure 5:
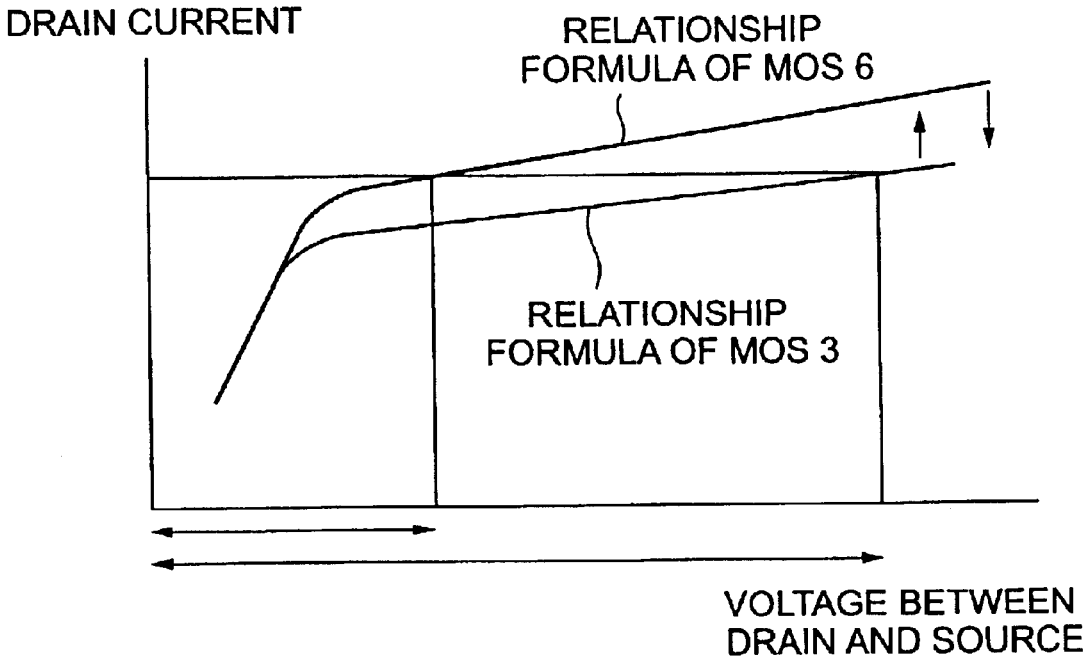
FIG. 5 shows a relationship formula between a drain-source voltage and a drain current in depletion transistors.

Operation of the present invention will be described with reference to FIG. 5. FIG. 5 shows a voltage between the drain and the source and a drain current in the respective depletion type MOS transistors 3 and 6. When sizes of the depletion type MOS transistors 3 and 6 are suitably set, drain currents flowing into the depletion type MOS transistors 3 and 6 are determined by the ED type reference voltage circuits 20 and 21.

At this time, assume that a difference of relationship formulas between a drain-source voltage and a drain current in the depletion type MOS transistors 3 and 6 is produced due to a cause such as mask shift.

At this time, a difference is produced between the drain-source voltage of the depletion type MOS transistor 3 and that of the depletion type MOS transistor 6. However, a gate voltage of the depletion type MOS transistor 3 is obtained by subtracting the drain-source voltage of the depletion type MOS transistor 6 from a voltage of the high voltage supply terminal 102. A gate voltage of the depletion type MOS transistor 6 is obtained by subtracting the drain-source voltage of the depletion type MOS transistor 3 from a voltage of the high voltage supply terminal 100. If the voltages of the high voltage supply terminals 100 and 102 are equal to each other, the gate voltage of the depletion type MOS transistor 3 in which the drain-source voltage thereof is high becomes a difference between the drain-source voltage of the depletion type MOS transistor 6 in which the drain-source voltage is low and the voltage of the high voltage supply terminal 102. Thus, the gate voltage rises so that the relationship formulas between the drain-source voltage and the drain current are changed as indicated by an arrow in the drawing. Even in the case of the depletion type MOS transistor 6, the gate voltage of the depletion type MOS transistor 6 in which the drain-source voltage thereof is low becomes a difference between the drain-source voltage of the depletion type MOS transistor 3 in which the drain-source voltage is high and the voltage of the high voltage supply terminal 100. Thus, the gate voltage falls so that the relationship formulas between the drain-source voltage and the drain current are changed as indicated by the arrow in the drawing.

Figure 6:
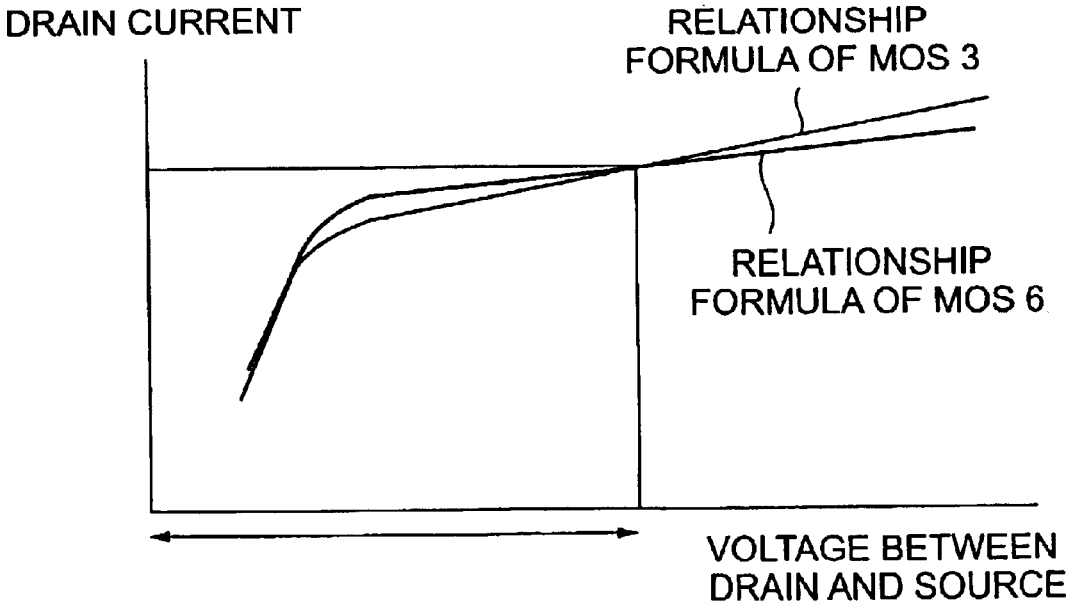
FIG. 6 shows a relationship formula between a drain-source voltage and a drain current in depletion transistors 3 and 6 according to the present invention.

FIG. 6 shows a relationship formula between the drain-source voltage and the drain current in the depletion transistors 3 and 6 according to the present invention. As shown in the drawing, each relationship formula between the drain-source voltage and the drain current is changed such that the respective drain-source voltages become the same potential. Thus, voltages supplied to the high voltage supply terminals 112 and 113 of the ED type reference voltage circuits 20 and 21 become the same potential so that voltages outputted to reference voltage output terminals 110 and 111 become equal to each other.

Note that even in the case of a reference voltage circuit having three ED type reference voltage circuits, the gate terminal of a depletion type MOS transistor of a first ED type reference voltage circuit is connected with the source terminal of a depletion type MOS transistor of a second ED type reference voltage circuit. The gate terminal of the depletion type MOS transistor of the second ED type reference voltage circuit is connected with the source terminal of a depletion type MOS transistor of a third ED type reference voltage circuit. The gate of the depletion type MOS transistor of the third ED type reference voltage circuit is further connected with the source of the depletion type MOS transistor of the first ED type reference voltage circuit. Even in this case, a difference of voltages applied to the respective ED type reference voltage circuits is reduced so that a difference of respective output voltages can be made small. Similarly, it can be also applied to the case of a reference voltage circuit having a plurality of ED type reference voltage circuits.

Figure 7:
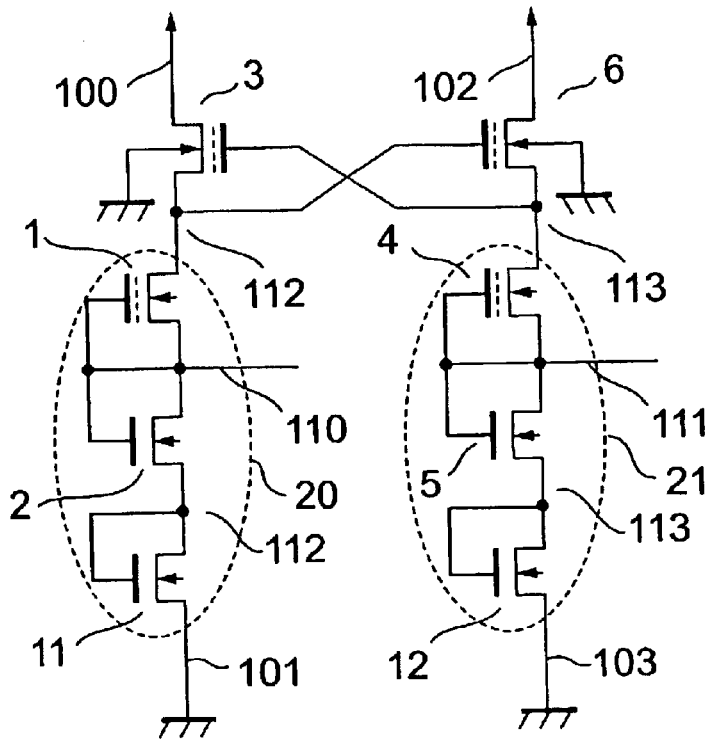
FIG. 7 shows another embodiment of a reference voltage circuit of the present invention.

FIG. 7 shows another embodiment of a reference voltage circuit of the present invention. Hereinafter, the embodiment of the present invention will be described with reference to FIG. 7. The source of a depletion type MOS transistor 1 and the drain of an enhancement type MOS transistor 2 having the same conductivity type are connected in series with each other. The gate and the source of the depletion type MOS transistor 1 are connected with each other. The gate and the drain of the enhancement type MOS transistor 2 are connected with each other. The drain of the depletion type MOS transistor 1 is connected in series with the source of a depletion type MOS transistor 3.

The source of the enhancement transistor 2 is connected in series with the drain of an enhancement transistor 11. The gate of the enhancement transistor 11 is connected with the source of the enhancement transistor 2. In order to output the same voltage, the same configuration is used. In other words, the source of a depletion type MOS transistor 4 having the same conductivity type and the drain of an enhancement type MOS transistor 5 are connected in series with each other. The gate and the source of the depletion type MOS transistor 4 are connected with each other. The gate and the drain of the enhancement type MOS transistor 5 are connected with each other. The drain of the depletion type MOS transistor 4 is connected in series with the source of a depletion type MOS transistor 6.

The source of the enhancement transistor 5 is connected in series with the drain of an enhancement transistor 12. The gate of the enhancement transistor 12 is connected with the source of the enhancement transistor 5. Further, the gate of the above depletion type MOS transistor 3 is connected with a high voltage supply terminal 113 of an ED type reference voltage circuit 21. The gate of the above depletion type MOS transistor 6 is connected with a high voltage supply terminal 112 of an ED type reference voltage circuit 20.

Also, the drain of the above depletion type MOS transistor 3 is connected with a high voltage supply terminal 100. The drain of the above depletion type MOS transistor 6 is connected with a high voltage supply terminal 102 of the ED type reference voltage circuit. In addition, the source of the above enhancement transistor 11 is connected with a low voltage supply terminal 101. The source of the above enhancement transistor 12 is connected with a low voltage supply terminal 103.

Further, a base potential of the above depletion transistor 3 having the same conductivity type is connected with the low voltage supply terminal 101. A base potential of the above depletion transistor 6 having the same conductivity type is connected with the low voltage supply terminal 103.

When such a configuration is used, an output voltage is changed regardless of threshold values with respect to the enhancement transistors and the depletion transistors so that a reference voltage circuit for generating two reference voltages with high precision can be constructed. According to the present explanation here, the number of series-connected enhancement transistors is only two. However, even when three or more enhancement transistors are connected in series with each other, a circuit can be similarly constructed.

Figure 8:
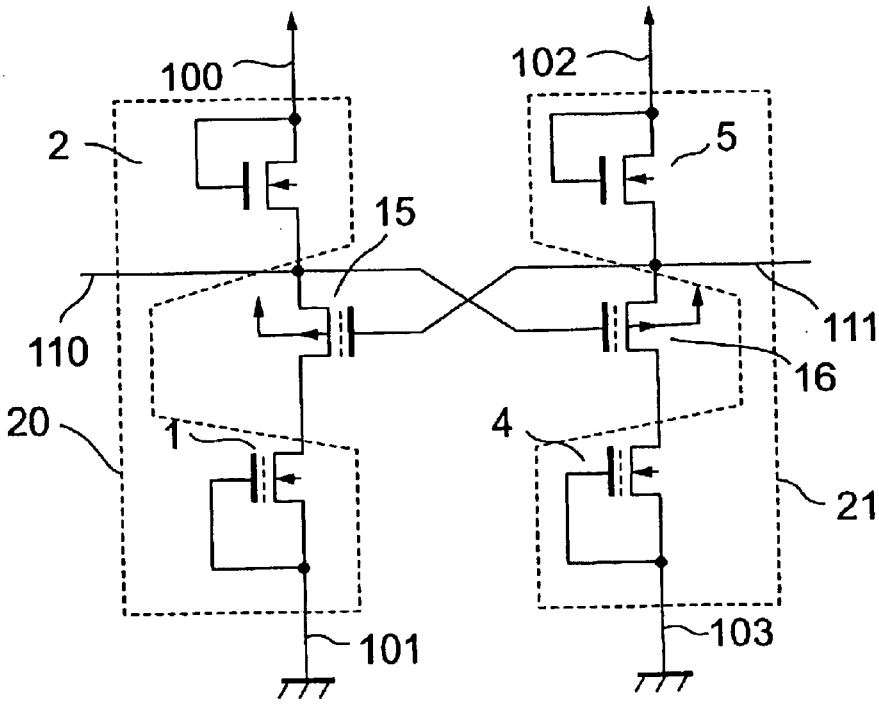
FIG. 8 shows another embodiment of a reference voltage circuit of the present invention.

FIG. 8 shows another embodiment of a reference voltage circuit using a high voltage as a reference according to the present invention. Hereinafter, an embodiment of the present invention will be described with reference to FIG. 8.

The drain of a depletion type MOS transistor 1 having the same conductivity type and the drain of a depletion transistor 15 having a different conductivity type are connected with each other. The source of an enhancement type MOS transistor 2 and the source of the depletion transistor 15 having the different conductivity type are connected in series with an output voltage terminal 110 of an ED type reference voltage circuit 20. The gate and the source of the depletion type MOS transistor 1 are connected with each other. The gate and the drain of the enhancement type MOS transistor 2 are connected with each other. In order to output the same voltage, the same configuration is used. In other words, the drain of a depletion type MOS transistor 4 having the same conductivity type and the drain of a depletion transistor 16 having a different conductivity type are connected with each other. The source of an enhancement type MOS transistor 5 and the source of the depletion transistor 16 having the different conductivity type are connected in series with an output voltage terminal 111 of an ED type reference voltage circuit 21. The gate and the source of the depletion type MOS transistor 4 are connected with each other. The gate and the drain of the enhancement type MOS transistor 5 are connected with each other. In addition, the gate of the above depletion type MOS transistor 15 having the different conductivity type is connected with the output voltage terminal 111 of the ED type reference voltage circuit 21. The gate of the above depletion type MOS transistor 16 having the different conductivity type is connected with the output voltage terminal 110 of the ED type reference voltage circuit 20. The drain of the above enhancement MOS transistor 2 is connected with a high voltage supply terminal 100. The drain of the above enhancement MOS transistor 5 is connected with a high voltage supply terminal 102 of the ED type reference voltage circuit. The source of the above depletion transistor 1 having the same conductivity type is connected with a low voltage supply terminal 101. The source of the above depletion transistor 4 having the same conductivity type is connected with a low voltage supply terminal 103.

Figure 9:
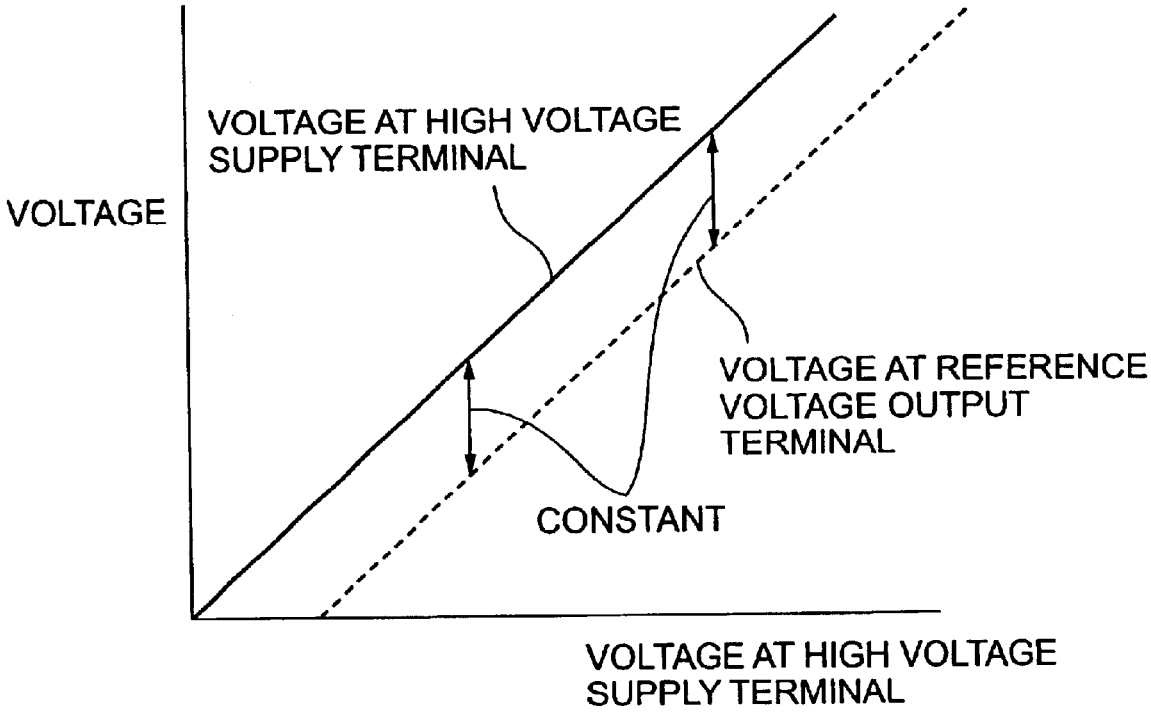
FIG. 9 is graph showing a relationship between an output voltage and a voltage at a high voltage supply terminal in the reference voltage circuit shown in FIG. 8.

Further, a base potential of the above depletion transistor 15 having the different conductivity type is connected with the high voltage supply terminal 100. A base potential of the above depletion transistor 16 having the different conductivity type is connected with the high voltage supply terminal 102. When such a configuration is used, a reference voltage circuit for generating two reference voltages with high precision using a high voltage as a reference as shown in FIG. 9 can be constructed.

According to an electronic device in the invention of the application concerned, it has the reference voltage circuit as described above. Thus, the reference voltage can be outputted with high precision so that the performance of the electronic device can be further improved.

According to the present invention, more particularly, the source of a depletion type MOS transistor is connected in series with the drain of a depletion type MOS transistor in each of two ED type reference voltage circuits. In addition, the gate of one of the series-connected depletion type MOS transistors is connected with the source of the other MOS transistor and the gate of the other MOS transistor is connected with the source of the one MOS transistor. Thus, a difference of voltages applied to the respective ED type reference voltage circuits is reduced so that a difference of respective output voltages is made small.

What is claimed is:

1. A reference voltage circuit comprising:

a first voltage terminal;

a second voltage terminal;

a first reference voltage circuit connected between the first voltage terminal and the second voltage terminal;

a first depletion mode MOS transistor connected between the first voltage terminal and the first reference voltage circuit;

a second reference voltage circuit connected between the first voltage terminal and the second voltage terminal; and a second depletion mode MOS transistor connected between the first voltage terminal and the second reference voltage circuit; wherein a gate terminal of the first depletion mode MOS transistor is connected with a potential between the second reference voltage circuit and the second depletion mode MOS transistor, and a gate terminal of the second depletion mode MOS transistor is connected with a potential between the first reference voltage circuit and the first depletion mode MOS transistor.

2. A reference voltage circuit according to claim 1; wherein the first and second reference voltage circuits are ED type reference voltage circuits each comprising a depletion mode MOS transistor and an enhancement mode MOS transistor which are connected in series with each other and have gate electrodes that are connected to each other, a voltage at a connection point of the enhancement mode MOS transistor and the depletion mode MOS transistor serving as a constant voltage output terminal.

3. An electronic device comprising a reference voltage circuit according to claim 1.

4. An electronic device comprising a reference voltage circuit according to claim 2.

5. A reference voltage circuit according to claim 1; wherein the first voltage terminal is a power source terminal and the second voltage terminal is a ground terminal.

6. A reference voltage circuit according to claims 1; wherein the first and second reference voltage circuits are ED type reference voltage circuits each comprising a series connected depletion mode MOS transistor and enhancement mode MOS transistor.

7. A reference voltage circuit according to claim 6; wherein gate electrodes of the depletion mode MOS transistor and the enhancement mode MOS transistor are commonly connected.

8. A reference voltage circuit according to claim 1; further comprising a third reference voltage circuit connected between the first voltage terminal and the second voltage terminal; and a third depletion MOS transistor connected between the first voltage terminal and the third reference voltage circuit; wherein the gate terminal of the second depletion MOS transistor is connected to a source terminal of the third depletion MOS transistor, and a gate terminal of the third depletion MOS transistor is connected to a source terminal of the first depletion MOS transistor.

9. An electronic device comprising a reference voltage circuit according to claim 1.

10. A reference voltage circuit comprising:

N ($2 \leqq N$, N is an integer) reference voltage circuits each including an enhancement mode MOS transistor and a depletion mode MOS transistor connected in series between a first voltage terminal and a second voltage terminal, a source of the depletion mode MOS transistor being connected to a drain of the enhancement mode MOS transistor, a source of the enhancement mode MOS transistor being connected to the second voltage terminal, a gate of the depletion mode MOS transistor being connected to the source thereof, a gate of the enhancement mode MOS transistor being connected with the drain thereof, and a connection point between the enhancement mode MOS transistor and the depletion mode MOS transistor being used as an output terminal; and N depletion mode MOS transistors each of which is connected between a respective one of the reference voltage circuits and the first voltage terminal; wherein a drain of a depletion mode MOS transistor of a first reference voltage circuit is connected in series with a source of a first depletion mode MOS transistor, a drain of a depletion mode MOS transistor of a second reference voltage circuit is connected in series with a source of a second depletion mode MOS transistor, the drains of the first and second depletion mode MOS transistors are connected to the first voltage terminal, substrate voltages of the first and second depletion mode MOS transistors are connected with the second voltage terminal, a gate of the first depletion mode MOS transistor is connected to the source of the second depletion mode MOS transistor whose drain is connected to the first voltage terminal, a drain of a depletion mode type MOS transistor of an (n−1) th ($2<n$, n is an integer) reference voltage circuit is connected in series with a source of an (n−1)th depletion mode MOS transistor, a drain of a depletion mode MOS transistor of an nth reference voltage circuit-is connected in series with a source of an nth depletion mode MOS transistor, the drains of the (n−1) th and nth depletion mode MOS transistors are connected with the first voltage terminal, base voltages of the (n−1)th and nth depletion mode MOS transistors are connected with the second voltage terminal, a gate of the (n−1)th depletion mode MOS transistor is connected with the source of the nth depletion mode MOS transistor, and a gate of nth depletion mode MOS transistor is connected with the source of the first depletion mode MOS transistor.

11. An electronic device comprising a reference voltage circuit according to claim 10.

12. A reference voltage generating circuit comprising: a pair of reference voltage circuits connected in parallel between first and second terminals; a first depletion mode MOS transistor connected between the first terminal and a first one of the reference voltage circuits; and a second depletion mode MOS transistor connected between the first terminal and a second one of the reference voltage circuits; wherein a gate terminal of the first depletion mode MOS transistor is connected between the second reference voltage circuit and the second depletion mode MOS transistor, and a gate terminal of the second depletion MOS transistor is connected between the first reference voltage circuit and the first depletion mode MOS transistor.

13. A reference voltage circuit according to claim 12; wherein the first and second reference voltage circuits are ED type reference voltage circuits each comprising a series connected depletion mode MOS transistor and enhancement mode MOS transistor.

14. A reference voltage circuit according to claim 13; wherein gate electrodes of the depletion mode MOS transistor and the enhancement mode MOS transistor are commonly connected.

15. A reference voltage circuit according to claim 12; further comprising a third reference voltage circuit connected between the first voltage terminal and the second voltage terminal; and a third depletion mode MOS transistor connected between the first voltage terminal and the third reference voltage circuit; wherein the gate terminal of the second depletion mode MOS transistor is connected to a source terminal of the third depletion mode MOS transistor, and a gate terminal of the third depletion mode MOS transistor is connected to a source terminal of the first depletion mode MOS transistor.

* * * * *